United States Patent [19]

Baxter

[11] Patent Number: 5,010,366

[45] Date of Patent: Apr. 23, 1991

[54] SLIDE TRANSPARENCY PROJECTOR APPARATUS FOR USE WITH AN ELECTROPHOTOGRAPHIC REPRODUCTION MACHINE

[75] Inventor: Carlton J. Baxter, Penfield, N.Y.

[73] Assignee: Eastman Kodak Company, Rochester, N.Y.

[21] Appl. No.: 366,396

[22] Filed: Jun. 15, 1989

[51] Int. Cl.[5] ..... G03G 15/04

[52] U.S. Cl. ..... 355/240; 355/232; 355/233

[58] Field of Search ..... 355/326, 327, 228-236, 355/232, 237, 240, 243, 244, 18; 353/120, DIG. 5, DIG. 6; 350/6.7, 6.8, 452

[56] References Cited

U.S. PATENT DOCUMENTS

| | | | |
|---|---|---|---|
| 3,094,036 | 6/1963 | Benson | 355/232 |
| 3,511,563 | 5/1970 | Erwin | 353/38 |
| 3,709,594 | 1/1973 | Hastwell | 355/327 |
| 3,758,774 | 9/1973 | Hildenbrandt | 240/103 R |
| 3,998,547 | 12/1976 | Schroter et al. | 355/68 |
| 4,027,962 | 6/1977 | Mailloux | 355/327 X |
| 4,043,656 | 8/1977 | Cherian | 355/327 X |
| 4,053,216 | 10/1977 | Mailloux | 355/239 |
| 4,053,217 | 10/1977 | Mailloux | 355/327 |
| 4,063,810 | 12/1977 | Mailloux | 355/327 |
| 4,068,939 | 1/1978 | Mailloux | 355/326 |
| 4,082,446 | 4/1978 | Driscoll et al. | 355/27 |
| 4,083,632 | 4/1978 | Mailloux et al. | 355/239 |
| 4,110,036 | 8/1978 | Guilloume | 355/32 |
| 4,111,540 | 9/1978 | Bollman | 355/326 |
| 4,111,542 | 9/1978 | Mailloux et al. | 355/308 |
| 4,120,580 | 10/1978 | Mailloux et al. | 355/327 |
| 4,234,250 | 11/1980 | Mailloux et al. | 355/326 |
| 4,246,605 | 1/1981 | LaRuosa | 358/104 |
| 4,498,763 | 2/1985 | Turner | 355/55 |
| 4,521,097 | 6/1985 | Kuehnle et al. | 355/210 |
| 4,547,061 | 10/1985 | Weber et al. | 355/326 |
| 4,575,228 | 3/1986 | Rightmyre | 355/71 |
| 4,585,330 | 4/1986 | Yamamoto et al. | 355/218 |
| 4,593,996 | 6/1986 | Kubono et al. | 355/271 |
| 4,636,062 | 1/1987 | Ohno et al. | 355/43 |
| 4,637,707 | 1/1987 | Kasahara et al. | 355/218 |
| 4,697,913 | 10/1987 | Yukimasa et al. | 355/202 |
| 4,701,044 | 10/1987 | Horiuchi et al. | 355/218 |

FOREIGN PATENT DOCUMENTS

| | | | |
|---|---|---|---|
| 2828245 | 1/1980 | Fed. Rep. of Germany | 353/DIG. 6 |
| 0002082 | 1/1988 | Japan | 355/326 |

*Primary Examiner*—Arthur T. Grimley
*Assistant Examiner*—Matthew S. Smith
*Attorney, Agent, or Firm*—Lawrence P. Kessler

[57] ABSTRACT

Apparatus for enabling an electrophotographic reproduction device to make reproductions of slide transparencies. The electrophotographic reproduction device includes a transparent platen for supporting information to be reproduced. A main lens assembly projects a focused image of information on the transparent platen onto a photoconductive member to form a latent image charge pattern of such information. The apparatus for enabling the electrophotographic reproduction device to make reproductions of slide transparencies comprises a mechanism for projecting a real image of a slide transparency along an optical path onto the transparent platen. A Fresnel lens, serving as a field lens for the main lens assembly, is located in the optical path of the projecting mechanism, between the projecting mechanism and the transparent platen, and space from the transparent platen so as to be beyond the depth of focus of the main lens assembly.

9 Claims, 3 Drawing Sheets

SLIDE TRANSPARENCY PROJECTOR APPARATUS FOR USE WITH AN ELECTROPHOTOGRAPHIC REPRODUCTION MACHINE

BACKGROUND OF THE INVENTION

This invention relates in general to electrophotographic reproduction machines, and more specifically to a slide transparency projector apparatus for use with an electrophotographic reproduction machine.

In typical electrophotographic reproduction machines (copiers or copier/duplicators), information to be reproduced is reduced to a latent image charge pattern on a photoconductive member. The charge pattern is developed with pigmented marking particles, and the developed charge pattern is subsequently transferred and fixed to a final receiver member to form the desired reproduction. The information to be reproduced is generally in the form of an original (hard copy) document or electronically stored data. When utilizing original documents, a document is placed on a transparent platen and illuminated to form a reflected light image of the document. The reflected light image is projected along an optical path to expose the photoconductive member and alter a uniform charge on the photoconductive member to form a latent image charge pattern corresponding image-wise to the reflected light image. When utilizing electronically stored data, electronic signals representative of data serves to drive a writer such as a laser or LED array to expose the photoconductive member and alter a uniform charge on the photoconductive member to form a latent image charge pattern corresponding image-wise to the data.

With the development of electrophotographic reproduction machines capable of reproducing information in multi-colors, it has become desirable to make reproductions wherein multi-color transparencies such as 35 mm slides are utilized as the information source. U.S. Pat. No. 4,027,962, issued Jun. 7, 1977, in the name of Mailoux, shows an exemplary projector apparatus for enabling a multi-color electrophotographic reproduction machine to reproduce transparencies or slides. Such apparatus includes a projector associated with the reproduction machine and a Fresnel lens, dot screen, and composition frame positioned on the transparent platen of the reproduction machine. The projector directs an image of the transparency through the Fresnel lens, dot screen, and composition frame onto the platen. The location of the Fresnel lens on the platen results in the facets of the lens, and any scratches or imperfections, showing up as undesirable artifacts in the transparency reproduction.

SUMMARY OF THE INVENTION

This invention is directed to an apparatus for enabling an electrophotographic reproduction machine to make reproductions of transparencies. The electrophotographic reproduction machine includes a transparent platen for supporting information to be reproduced. A main lens assembly projects a focused image of information on the transparent platen onto a photoconductive member to form a latent image charge pattern of such information. The apparatus for enabling the electrophotographic reproduction machine to make reproductions of transparencies comprises a mechanism for projecting a real image of a transparency along an optical path onto the transparent platen. A Fresnel lens, serving as a field lens for the main lens assembly, is located in the optical path of the projecting mechanism, between the projecting mechanism and the transparent platen, and spaced from the transparent platen so as to be beyond the depth of focus of the main lens assembly.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
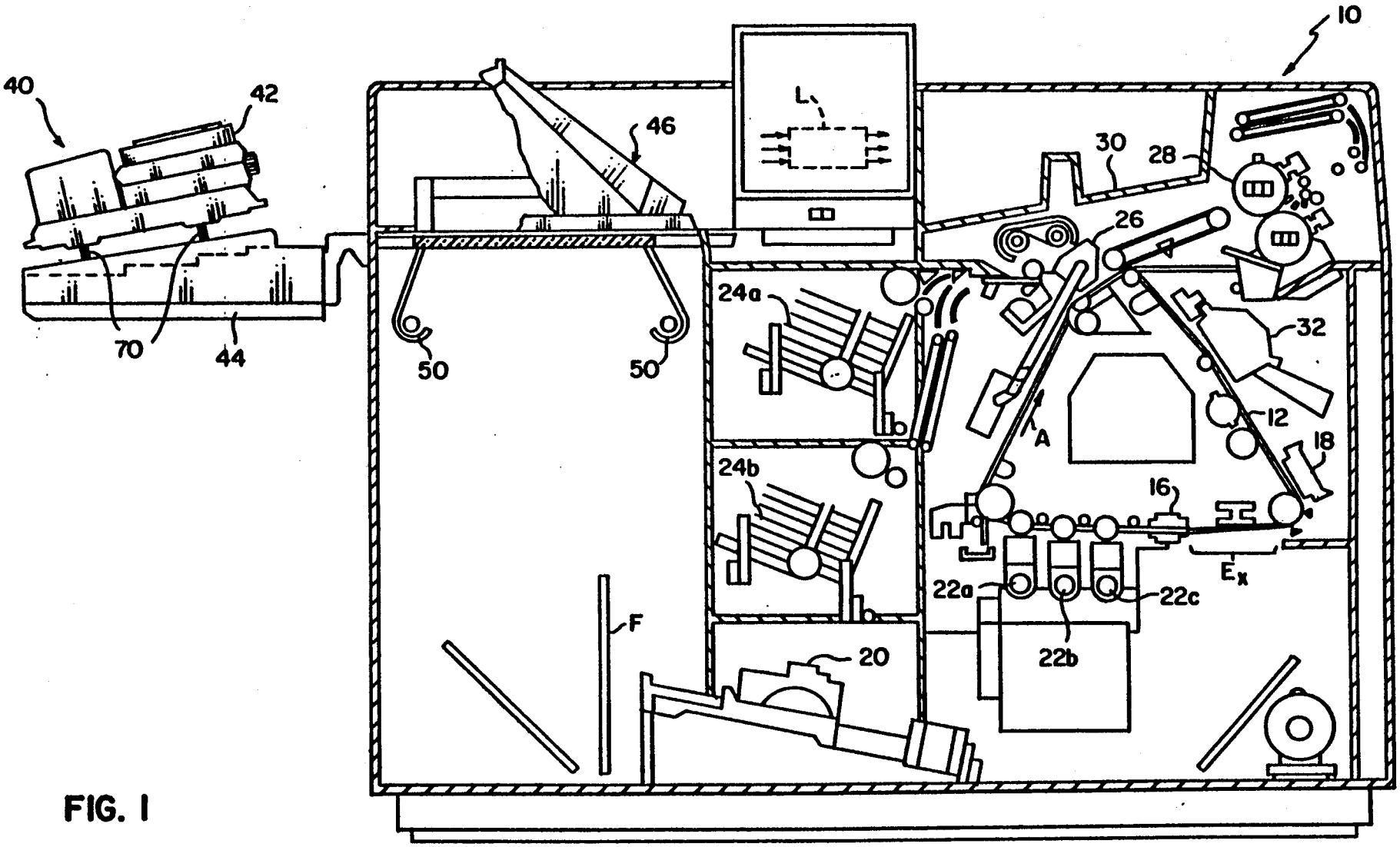
FIG. 1 is a front elevational view, partly in cross-section, of a generally schematic illustration of the slide transparency projector apparatus and electrophotographic reproduction machine of FIG. 1.
Figure 2:
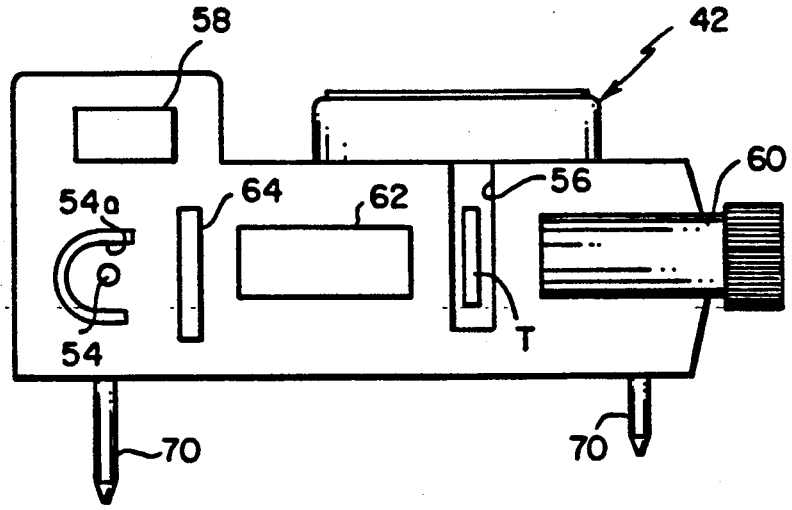
FIG. 2 is a view in cross-section, and on an enlarged scale, of the slide transparency projector of the projector apparatus of FIG. 1.

Referring now to the accompanying drawings, FIG. 1 shows an exemplary electrophotographic reproduction machine, designated by the numeral 10, associated with a slide transparency projector apparatus, according to this invention, designated generally by the numeral 40. The reproduction machine 10, which is capable of making multi-color reproductions, includes an endless dielectric web 12 supported by rollers, one of which is driven by motor M to move the web 12 about a closed loop path in the direction of arrow A (see FIG. 2). The web 12 is a composite structure having a photoconductive surface layer, with a plurality of successive image receiving areas, and a grounded conductive support layer such as shown for example in U.S. Pat. No. 3,615,414 (issued Oct. 26, 1971 in the name of Light). While this invention will be discussed with reference to use with the exemplary electrophotographic reproduction machine, of course other reproduction machine configurations are suitable for use with this invention.

Typical electrostatographic process stations are located about the periphery of the web 12 in operative relation with the image receiving areas. Control of the reproduction machine 10 and the electrostatographic process stations are accomplished by a logic and control unit L including a microprocessor for example. The microprocessor receives operator input signals and timing signals, for example from a sensor (not shown) detecting movement of the web 12 about its closed loop path. Based on such signals and a program for the microprocessor, the unit L produces signals to control the timing operation of the various electrostatographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

The electrostatographic process stations function in the following manner to produce multi-color copies of multi-color information. A corona charger 18, coupled to a D.C. or biased A.C. electrical potential source (not shown), applies a uniform electrostatic charge to the web 12 as it moves past the charger. The uniform charge, in successive adjacent image receiving areas of the web, is altered as the web passes through zone $E_X$ to form respective latent image-wise charge patterns in such areas corresponding to images of the information to be copied. For example, color separation latent image-wise charge patterns are formed by exposure of the image-receiving area of the web to appropriately filtered reflected light images of a multi-color document located on a transparent platen P. That is, reflected light images, formed by illuminating the document, are directed along an optical path through respective color filters of filter wheel F. Of course, formation of image-wise charge patterns on the web may be alternately accomplished by other suitable methods such as by exposure to electronically (e.g. LED array or laser scanner) or electrostatically produced images.

Travel of the web 12 brings the areas bearing the latent charge patterns successively into a development zone having a plurality of developer stations 22*a*–22*c*. The developer stations may be of the magnetic brush type such as described in U.S. Pat. No. 4,707,107, issued Nov. 17, 1987, in the name of Joseph, containing different colored marking particles respectively. If for example, the charge patterns correspond respectively to red, green, and blue color separation images, the colored marking particles in the respective developer stations are cyan, magenta and yellow. Such marking particles exhibit a triboelectric charge of a polarity opposite to that of the charge patterns to be developed. Under the control of the logic and control unit L, the developer stations 22*a*–22*c* are actuated to bring their associated marking particles into contact with corresponding charge patterns so that the marking particles adhere to the image areas to respectively develop the charge patterns with the appropriately colored marking particles. That is, the charge pattern corresponding to the red color separation image is developed with cyan marking particles, the charge pattern corresponding to the green color separation image is developed with magenta marking particles, and the charge pattern corresponding to the blue color separation image is developed with yellow marking particles. Of course, other schemes for producing color developed images are suitable for use with this invention.

The marking particle developed images are sequentially transferred in accurate superimposed register to a receiver member (e.g., a cut sheet of plain bond paper) to form a multi-color reproduction of the information to be reproduced. A receiver member is transported from a supply stack 24*a* (or 24*b*) to a transfer device 26, such as an electrically biased transfer roller of the type shown in U.S. Pat. No. 4,724,458, issued Feb. 9, 1988 in the name of Roy et al for example. The receiver member is tacked to the transfer device 26 in any well known manner such as by vacuum or mechanical clamps. In timed relation with the passage of the web areas bearing the developed images, the transfer device 26 presents the receiver member in nip relation with the web, and the electrical field of the transfer device effects transfer of the marking particles to the receiver member in superimposed register.

After the transfer of the last of the successive marking particle developed images to the receiver member, the member is detacked from the transfer device 26 and transported to a fixing apparatus 28 where the marking particles are fused to the member by heat and/or pressure for example. The receiver member bearing the multi-color reproduction is then delivered to an output hopper 30 for operator retrieval. While the marking particles are being fixed to the receiver member, the web 12 continues to travel about its closed loop path through a cleaning mechanism 32 where any residual marking particles are removed, and then returned to the vicinity of the charger 18 where it is ready for reuse in the reproduction process.

The projection apparatus 40 according to this invention, for enabling the reproduction machine 10 to reproduce transparencies such as 35 mm slides, includes a projector 42 mounted on a support 44. The support 44 is attached to the housing of the reproduction machine 10 adjacent to the transparent platen P. The projector 42, which is for example a modified Ektagraphic III slide projector manufactured by Eastman Kodak Co. of Rochester, N.Y., projects a real image of a slide onto the platen P. A three sided assembly 46 is supported on the housing of the reproduction machine 10 in juxtaposition with the platen P. The assembly 46 includes a mirror 46*a* intersecting the optical path from the projector and oriented at an angle from the horizontal so as to direct the optical path, from the projector, perpendicular to the platen. In this manner the projector can be located substantially horizontally on the support 44 so as not to interfere with the normal slide transparency handling function thereof.

Figure 3:
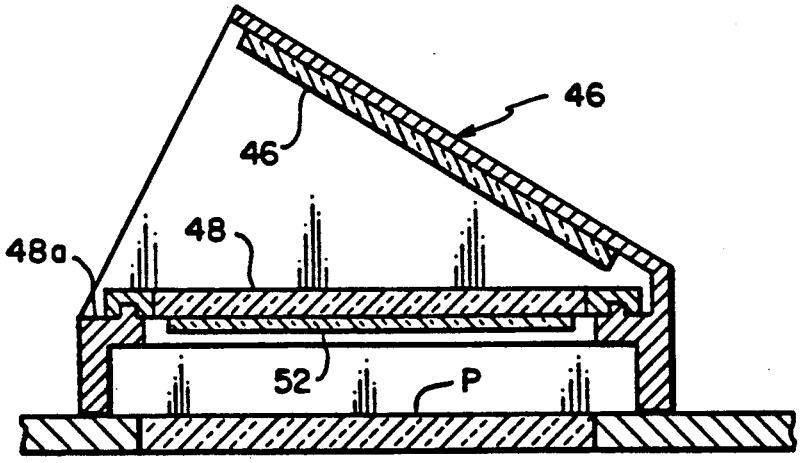
FIG. 3 is a view in cross-section, and on an enlarged scale, of the Fresnel holder of the projector apparatus of FIG. 1.

The real image projected onto the platen P by the projector 42 serves as the object for the main reproduction machine lens 20. However, slide transparency projecting light from only a small circular area would actually enter the entrance pupil of the main lens. Therefore, a field lens is necessary to redirect the rays outside of this area into the entrance pupil. Fresnel lens 48, in the optical path between the projector 42 and the platen P serves as a field lens without effecting the imaging characteristics of the optical system. The Fresnel lens 48 is retained in a holder 48*a* mounted within the assembly 46 (see FIG. 3). The holder 48*a* locates the Fresnel lens 48 at predetermined spaced distance from the platen out of focus of the main lens 20. This has been found to prevent the Fresnel facets, scratches, dirt, or other imperfections from being reproduced on the slide transparency reproduction. While the spacing of the Fresnel lens 48 from the platen P would somewhat reduce the image size, such size variation is compensated for by adjusting the placement of the projector 42 on the support 44.

The use of a Fresnel lens creates an image of the main lamps 50 of the reproduction machine exposure mechanism. If not compensated for, the image of the lamps would alter the charge pattern on the photoconductor 12, and produce unwanted artifacts on the slide transparency reproduction. It has been found that a light attenuator 52, such as a neutral density filter with a transmission factor of approximately 50%, when attached to the Fresnel lens 48 between the Fresnel lens and the platen P, eliminates the imaging of the lamps 50. This is due to the fact that the energy from the main lamps 50 has to pass through the light attenuator 52 twice, thus reducing it to approximately 25% of its original level. On the other hand, the energy from the lamp of the projector 42 only passes through the filter 52 once, thereby increasing the contrast between the projected slide transparency image and the unwanted reflections of the main lamps. As an alternate to the light attenuator, a Fresnel doublet is also suitable for use with this invention.

The modifications necessary for the projector 42, in order for it to function properly with the reproduction machine 10, are directed primarily to the projector's illumination system. The modifications are required to enable the projector to establish substantially uniform exposure light distribution, of a short duration, on the slide transparency. Uniform exposure light distribution is necessary due to the absolute sensitometry of the photoconductor 12 which makes the photoconductor relatively intolerant of non-uniform illumination. The short duration of the exposure light is required since the exposure of the photoconductor occurs while the photoconductor is in motion and a prolonged exposure would result in a reproduction which would appear to be smeared. Accordingly, a Xenon flash lamp 54 is substituted for the standard tungsten light source to supply the necessary short duration exposure illumination for a slide transparency T retained in the standard slide gate 56 of the projector 42 (see FIG. 2). A power supply 58 for the Xenon flash lamp 54 is controlled to operate the lamp in two distinct modes. In the first mode a single short duration flash of the Xenon flash lamp is initiated for photoconductor exposure to an image of a slide transparency; and in the second mode the Xenon flash lamp is strobed at a frequency sufficient to provide a persistent image of a slide transparency on the platen where the image can be inspected to assess its location, focus, and composition relative to the reproduction which will be made of such slide transparency. If necessary, a sheet of paper or silvered screen can be placed on the platen to enhance viewing of the slide transparency during inspection.

Light from the Xenon flash lamp 54 is directed through a slide transparency T in the slide gate 56, to the projector objective 60 onto the platen P, by a lamp reflector 54*a*. To establish the required exposure illumination uniformity, a light integrating bar 62 with light diffusing ends is interposed between the lamp 54 and the projector objective 60. It has been found that an integrating bar formed for example of an acrylic material of substantially square cross-section, with one end glass bead blasted to cause the desired light diffusion characteristics, provides the required uniformity of exposure light distribution. The Xenon flash lamp 54, on operation particularly in the strobe mode, produces heat of sufficient quantity to potentially cause damage or distortion of the integrating bar 62 or the slide transparency in the gate 56. Accordingly, a sheet of heat-absorbing glass 64 is interposed between the lamp 54 and the bar 62 to reduce the amount of heat reaching the bar and slide transparency.

A slide transparency may be reproduced by the reproduction machine 10 on a receiver member at several particular locations and magnification ratios. Such locations and ratios are selected so as to enable the slide transparency image to be desirably positioned on the finished reproduction. For example, a slide transparency image may take up substantially an entire standard size receiver member (8½"×11" sheet of plain bond paper for example), or may be of either of two different lesser sizes located respectively at other positions on such standard receiver member. At each particular location and magnification ratio, a respective preselected mask is placed on the platen P to provide a suitable border around the slide transparency image. The mask reflects light from the main lamps 50 to alter the charge pattern on the photoconductor 12 outside the slide transparency image. The light reflected from the mask thus prevents toner deposit in the area surrounding the slide transparency image where no illumination (and heavy toner lay down) would otherwise occur. The resultant reproduction then shows an attractive frame around the reproduced slide transparency image. Additionally, information (such as descriptive information relative to the slide transparency being reproduced) can be pasted up on the mask to be merged with the slide transparency image on reproduction so as to form a composite image of both graphics and text for example.

Figure 4:
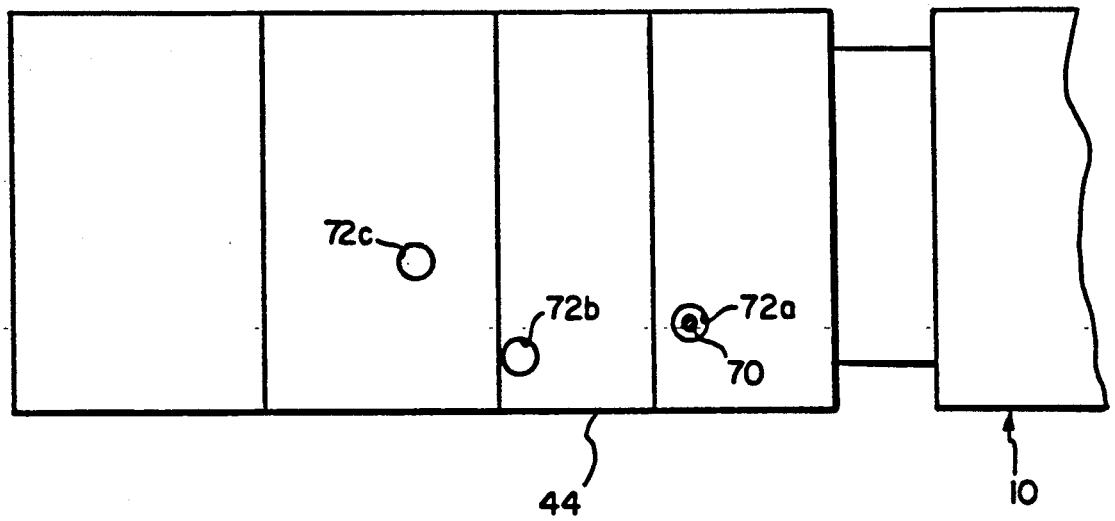
FIG. 4 is a top plan view, on an enlarged scale, of the slide transparency projector support.
Figure 5:
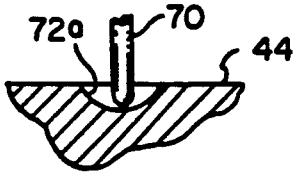
FIG. 5 is a view in cross-section, and on an enlarged scale, showing the cooperation between the projector leg and the projector locating holes in the support.

In order to simplify proper location of the projector 42 relative to the reproduction machine 10 to yield the selectable locations and magnification ratios of the reproduced slide transparency image, the projector is positionable at particular locations on the support 44. Specifically, as best shown in FIGS. 1, 4, and 5, the projector 42 has three legs 70, one of which selectively mates with one of three holes 72*a*, 72*b*, or 72*c* located in the support 44. Each of the holes is located so as to position the projector 42 at the proper location on the support 44, in mutually perpendicular directions in a substantially horizontal plane, for a respective particular projected slide transparency image location and corresponding magnification ratio. Further, the holes are respectively at different vertical elevations due to the stepped configuration of the support 44 (see FIG. 2). Accordingly, the leg 70 cooperating with the respective hole 72*a*, 72*b*, or 72*c* properly locates the projector 42 in the direction perpendicular to the aforementioned substantially horizontal plane. Additionally, for each location of the projector in a selected hole, the projector apparatus 40 has a particularly associated projector objective 60, Fresnel lens 48, and light attenuator 52. This enables the magnification ratio, Fresnel pattern, and light attenuation to be optimally tailored for each location. As such the reproduced slide transparency from any particular location will always be in focus, with its image properly located on the reproduction at the desired magnification ratio. Of course, the variables effecting focus, image location, and magnification ratio can be readily changed for different slide formats.

In operation, the projector 42 is located on the support 44 at the particular position in association with a selected hole 72*a*, 72*b*, or 72*c* for a desired particular slide transparency image position and magnification ratio on a receiver member as described above. The appropriate projector objective for the particular selected position is located in the projector, the Fresnel lens/light attenuator combination for such position is placed in the holder 48*a*, and the appropriate mask is located in the assembly 46 on the platen P. The projector 42 is electrically coupled to the reproduction machine 10 to communicate with the logic and control unit L to indicate that the projector apparatus 40 is to be used as the source of information to be reproduced. Accordingly, when the projector 42 is actuated to advance a slide transparency T into the gate 56, a signal is sent to the unit L to indicate that a copy run using the projector as the information input source can begin. After the operator sets the reproduction machine for the number of reproductions of each slide transparency to be made and initiates the reproduction process by pressing the start copy button, a signal is sent from the unit L to the power supply 58 to fire the Xenon flash lamp 54 in synchronization with the operation of the electrostatographic process of the reproduction machine 10. When the requisite number of images of a slide transparency necessary to produce the corresponding number of desired multi-color reproductions has been formed, the unit L sends a signal to the projector 42 to index the projector to bring the next slide transparency into the gate 56. This process is repeated until, upon supply of an index signal, no slide transparency appears in the gate. The unit L interprets this "no slide transparency in the gate" condition as an end-of-run signal and causes the reproduction machine 10 to cycle out. Of course at any time, the projector can be operated independently, in the strobe mode, to enable a slide transparency to be viewed on the platen P for inspection prior to reproduction.

The invention has been described in detail with particular reference to preferred embodiments thereof, but it will be understood that variations and modifications can be effected within the spirit and scope of the invention.

I claim:

1. For use with an electrophotographic reproduction machine including a transparent platen for supporting information to be reproduced, means for exposing information located on said transparent platen, a photoconductive member upon which latent image charge patterns of such information are formed, and a main lens assembly for projecting focused image of information on said transparent platen onto said photoconductive member to form such latent image charge patterns, apparatus for enabling said electrophotographic reproduction machine to make reproductions of slide transparencies, said apparatus comprising:

means for projecting a real image of a slide transparency along an optical path onto said transparent platen;

a Fresnel lens; and means for supporting said Fresnel lens in said optical path of said projecting means as a field lens for said main lens assembly, said supporting means maintaining said Fresnel lens in spaced relation to said transparent platen beyond the depth of focus of said main lens assembly.

2. The invention of claim 1 wherein said projecting means includes a slide transparency gate adapted to selectively receive a slide transparency, a light source, means for activating said light source, and means for directing light from said light source when activated uniformly through said slide transparency in said gate.

3. The invention of claim 2 wherein said light directing means includes an integrating bar of substantially square cross-section having at least one light diffusing end.

4. The invention of claim 2 wherein said light source activating means includes control means for selectively activating said light source in a single short duration pulse or a plurality of strobed pulses of a frequency sufficient to provide a persistent slide transparency image at said platen.

5. The invention of claim 1 further including means for supporting said projection means adjacent to said transparent platen, said supporting means for said projection means having locating means for selectively positioning said projection means relative thereto in three mutually perpendicular directions to provide different positions and magnification ratios for the projected real image of a slide transparency on said transparent platen.

6. The invention of claim 1 wherein said means for supporting said Fresnel lens includes a holder located adjacent to said transparent platen, said holder having means for receiving and retaining said Fresnel lens in spaced relation to said transparent platen between said projection means and said transparent platen.

7. The invention of claim 6 further including a light attenuator located between said Fresnel lens and said transparent platen.

8. The invention of claim 7 wherein said means for supporting said Fresnel lens additionally supports a mirror intercepting said optical path from said projecting means at an angle oriented to direct said optical path through said Fresnel lens and said light attenuator substantially perpendicularly to said transparent platen.

9. A reproduction machine capable of making multicolor reproductions of multi-color information including slide transparencies, said reproduction machine comprising:

a transparent platen for supporting information to be reproduced, means for exposing information located on said transparent platen, a photoresponsive member upon which a latent image of such information is formed, and a main lens assembly for projecting focused image of information on said transparent platen onto said photoresponsive member to form such latent image; and projection means for supplying information to be reproduced from slide transparencies, said projection means including means for projecting a real image of a slide transparency along an optical path onto said transparent platen, a Fresnel lens, and means for supporting said Fresnel lens in said optical path of said projecting means as a field lens for said main lens assembly, said supporting means maintaining said Fresnel lens in spaced relation to said transparent platen beyond the depth of focus of said main lens assembly.

* * * * *